United States Patent [19]

Focke et al.

[11] Patent Number: 4,840,007

[45] Date of Patent: Jun. 20, 1989

[54] PACKAGING MACHINE WITH A DRYING TURRET

[75] Inventors: Heinz Focke; Kurt Liedtke, both of Verden, Fed. Rep. of Germany

[73] Assignee: Focke & Co. (GMBH & Co.), Verden, Fed. Rep. of Germany

[21] Appl. No.: 140,188

[22] Filed: Dec. 31, 1987

[30] Foreign Application Priority Data

Jan. 22, 1987 [DE] Fed. Rep. of Germany ..... 3701768

[51] Int. Cl.[4] ..... B65B 11/28; B65B 51/06; B65B 19/22

[52] U.S. Cl. ..... 53/137; 53/202; 53/234; 53/387

[58] Field of Search ..... 53/234, 387, 388, 202, 53/137

[56] References Cited

U.S. PATENT DOCUMENTS

| | | | |
|---|---|---|---|
| 2,949,001 | 8/1960 | Zwarycz | 53/203 X |
| 2,974,460 | 3/1961 | Walther | 53/387 X |
| 3,590,556 | 7/1971 | Focke | 53/234 X |
| 4,150,520 | 6/1979 | Palmieri | 53/234 X |
| 4,179,864 | 12/1979 | Focke | 53/234 X |
| 4,330,976 | 5/1982 | Blackall | 53/234 X |
| 4,484,432 | 11/1984 | Operdorf | 53/234 X |
| 4,718,216 | 1/1988 | Focke | 53/202 X |

FOREIGN PATENT DOCUMENTS

| | | | |
|---|---|---|---|
| 2308714 | 8/1973 | Fed. Rep. of Germany . | |
| 2643600 | 3/1978 | Fed. Rep. of Germany | 53/234 |

*Primary Examiner*—John Sipos

*Attorney, Agent, or Firm*—Sughrue, Mion, Zinn, Macpeak & Seas

[57] ABSTRACT

In the production of packs (10), especially cigarette packs, it is necessary to allow glue spots for bonding folding tabs together to set or harden sufficiently before the packs are discharged from the packaging machine. For this purpose, the packs (10) are introduced temporarily into a drying turret (13).

To ensure that the drying turret (13) has a large a capacity as possible, it is equipped with pairs of two drying pockets (25, 26) located next to one another, such pairs of drying pockets (25, 26) being distributed at a short distance from one another along the periphery of the drying turret (13), specifically in a plane which differs slightly from the radial plane. During the pushing of the packs (10) into and out of the drying pockets (25, 26), closing stamps (40) or revenue stamps (41) can be attached.

8 Claims, 3 Drawing Sheets

PACKAGING MACHINE WITH A DRYING TURRET

BACKGROUND OF THE INVENTION

The invention relates to a packaging machine for cuboid packs, especially cigarette packs, having glue bonds, with at least one folding turret and with a following drying turret for receiving the ready-folded packs temporarily in drying pockets.

Drying turrets are used in conjunction with packaging machines when packs with glue bonds are to be produced, that is to say, for example, in the production of cigarette packs. It is important to allow the packs to stay as long as possible in the drying turret, so that the glue bonds can set sufficiently and the shape of the pack is stabilized. On the other hand, it is necessary to ensure that the production flow is not impeded even on the particularly high-performance packaging machines used for cigarettes.

SUMMARY OF THE INVENTION

The object on which the invention is based is to develop further and improve a packaging machine in terms of the region where the glue bonds are dried, to the effect that the packs are received in drying pockets of the drying turret for a sufficiently long time, but a considerable output of packs can be achieved nevertheless.

To achieve this object, the packaging machine according to the invention is characterized in that the drying turret has a plurality of, especially two drying pockets open at both ends in the axial direction, each for receiving a pack, located next to one another in a radial plane or in a plane directed at a small angle relative to the radial plane.

Because the drying pockets are arranged according to the invention adjacent to the outer periphery of the drying turret, a maximum utilization of capacity for a predetermined size of the drying turret is possible. According to the invention, the packs are fed, by means of a horizontal feed conveyor, to a pushing-in station, in which the packs, lying horizontally, are pushed into the drying pockets located next to one another in pairs, in a plane which, because of the relative position of the latter, is slightly below the horizontal mid-plane of the drying turret rotating in a vertical plane.

The packs are transported along a conveying distance of approximately 270° in the drying turret and are therefore located in the drying pockets for a relatively long time. In the region of a pushing-out station above the horizontal mid-plane of the folding turret, the packs are ejected, with the two drying pockets being aligned in a vertical plane.

The drying pockets are open at both axial ends, so that the packs can be pushed in and ejected in the same direction.

Furthermore, measures according to the invention are taken, in order, when the packs are pushed into the drying pockets and/or when they are ejected from the latter, to attach closing stamps or revenue stamps to the respective upper pack end faces pointing forwards in the pushing direction. For this purpose, carrier members for the closing or revenue stamps are arranged respectively between the feed conveyor and drying turret or between the drying turret and a discharge conveyor for the packs. The packs are pushed through mouthpiece orifices in the carrier members, a closing stamp or revenue stamp thereby being taken up.

Further features of the invention relate to the design of the drying turret and of additional members, especially the feed and discharge of the packs.

BRIEF DESCRIPTION OF THE DRAWING

An exemplary embodiment of the invention is explained in detail below with reference to the drawings. In these.

DETAILED DESCRIPTION OF A PREFERRED EMBODIMENT

Figure 1:
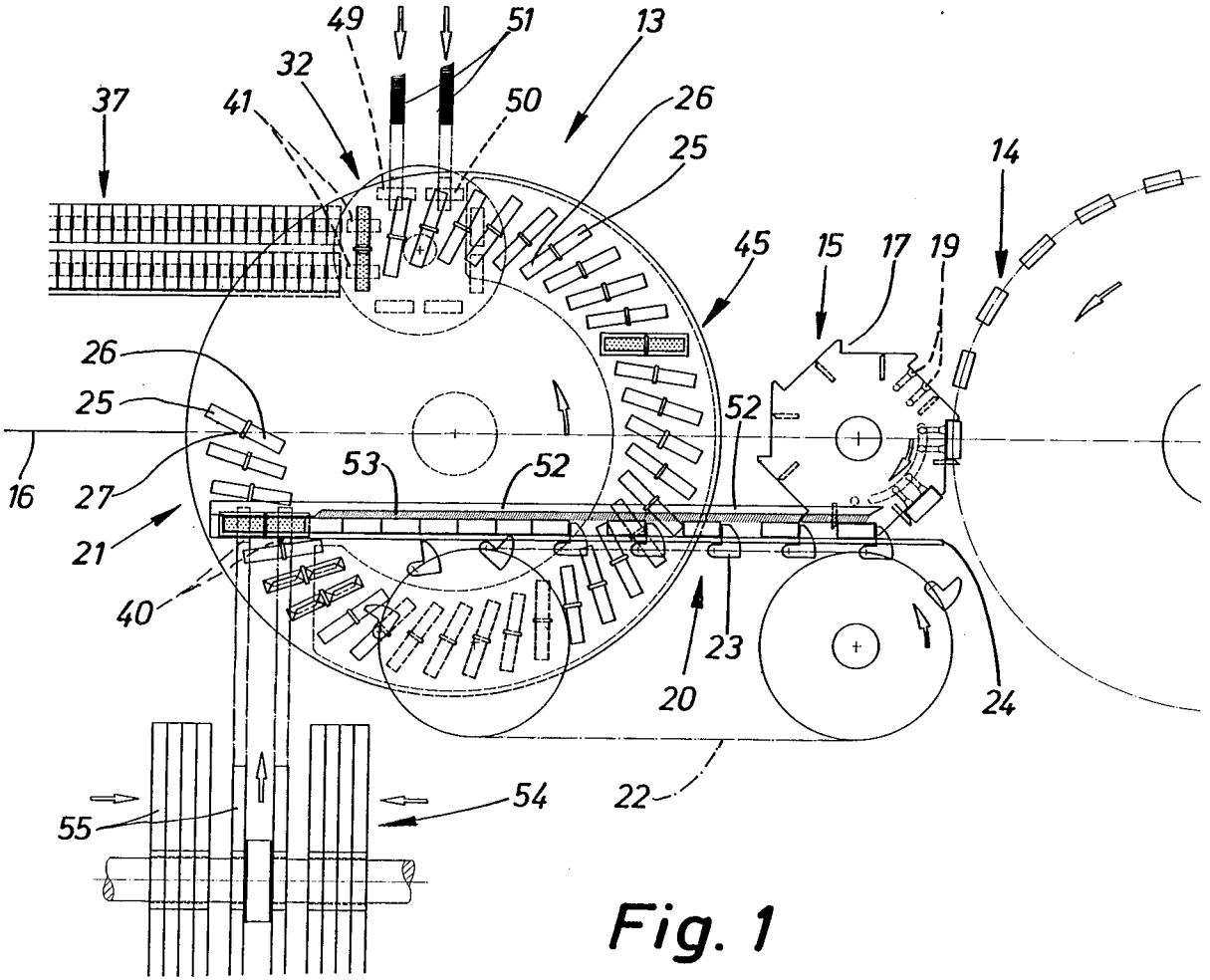
FIG. 1 shows a diagramatic side view of part of a packaging machine with a drying turret.
Figure 2:
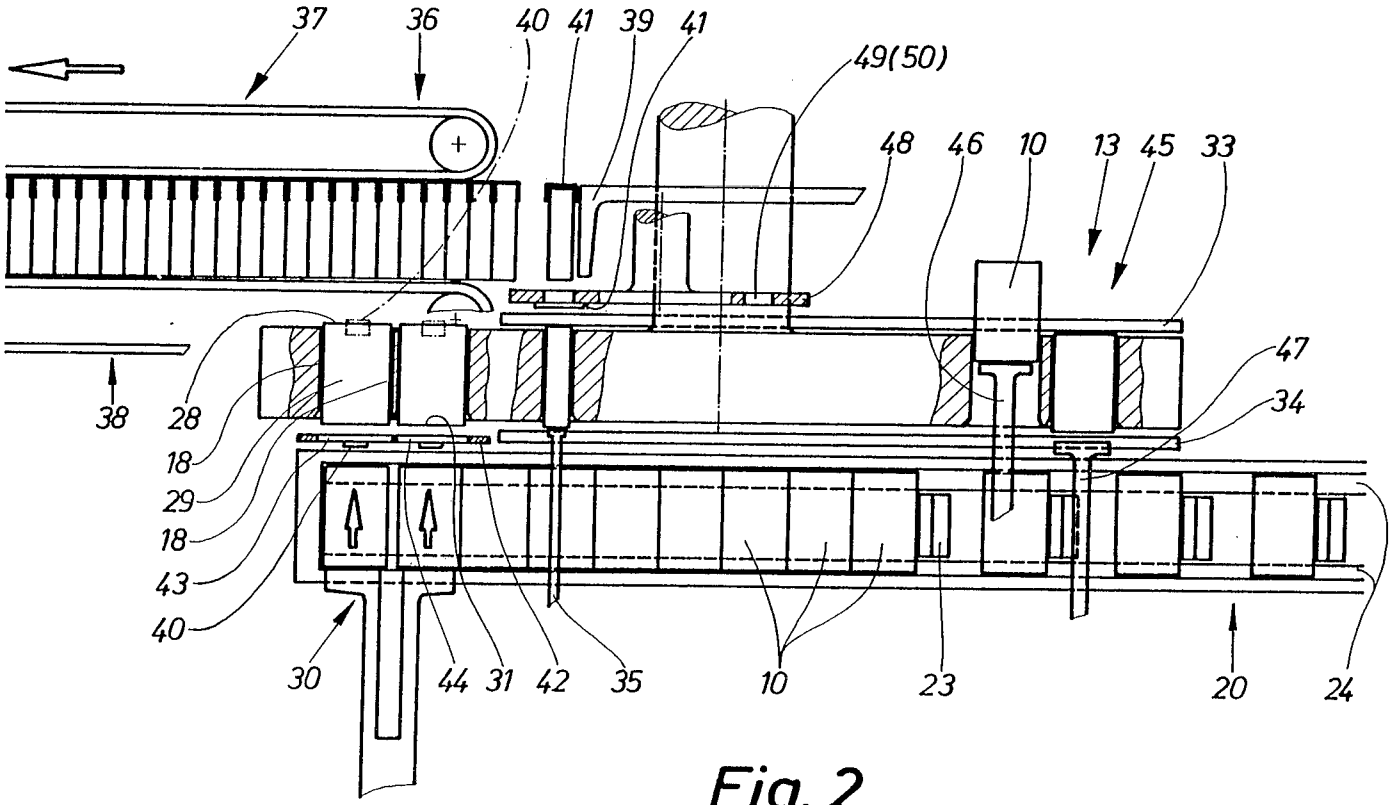
FIG. 2 shows a horizontal projection relative to FIG. 1 in the region of the drying turret on an enlarged scale.

The apparatus illustrated in the drawings is concerned with the production or completion of cuboid packs 10, specifically cigarette packs of the soft-cup type especially. Such packs mainly consist of a blank made of paper or cardboard. Folding tabs overlapping one another completely or partially are bonded to one another by means of glue. In the present exemplary embodiment shown in FIG. 3, tubular tabs 11 and 12 are bonded to one another by glueing in the region of a narrow vertical side wall of the pack 10.

For setting the glue bonds and for stabilizing the cuboid shape of the packs 10, they are temporarily received by a drying turret 13, in which the packs 10 are kept in shape and, above all, dried as a result of the supply of heat in the region of the glue spots.

The drying turret 13 is an integral part of a packaging machine. Of this, FIG. 1 shows diagramatically a part of a folding turret 14. This is equipped with pockets, each receiving a pack, and with folding members which make folds on the blank during the transport of the packs 10.

The packs 10 are transferred from the folding turret 14 to a transfer turret 15 which takes over the packs in the region of a horizontal main plane 16. For this purpose, the transfer turret 15 is equipped, along the periphery, with pack receptacles 17 which are open on the side located at the front in the conveying direction. The packs 10 accordingly enter the pack receptacle 17 of the transfer turret 15 automatically as a result of the rotary movement of the latter. A side wall 18 moveable in the radial direction is then extended from the retracted position into a holding position for fixing the packs 10 on the open side of the pack receptacle 17. The pack 10 is held by means of suction bores 19 so as to prevent it from sliding out of the resulting pocket of the transfer turret 15.

On the underside of the transfer turret 15 rotating in a vertical plane, the packs 10 are transferred to a feed conveyor 20 running in a horizontal plane as a result of the venting of the suction bores 19 and the radially directed retraction of the side wall 18. The packs 10 are delivered by the feed conveyor 20 to a supply station 21 for the drying turret 13.

In the present case, the feed conveyor 20 is designed as a pawl conveyor, with engaging pawls 23 arranged at distances from one another on an endless conveyor chain 22. They are arranged on the conveyor chain 22 in such a way that each pack 10, resting on stationary lateral conveying rails 24, is grasped at the rear by the engaging pawl 23. The packs 10 are first conveyed at a distance from one another because of the distances between the engaging pawls 23. However, in a region facing the supply station 21, the packs 10 are brought close up to one another.

For this purpose, the feed conveyor 20 is designed in a special way, in particular with the features of the conveyor of DE Patent P1,299,239. Accordingly, the engaging pawls 23 are attached to the conveyor chain 23 so as to be pivotable against elastic pressure. The elastic pressure is sufficient to transport the packs 10 on the conveying rail 24. However, when the packs 10 run up against the close-packed row, the engaging pawls 23 are pivoted away rearwards as a result of the increased pressure. The engaging pawls 23 now run through underneath the row of packs 10, until they come free of the latter and swing back into the normal position, in particular the engaging position, as a result of the elastic pressure. The movement of the engaging pawls 23 out of the engaging position into a position underneath the packs 10 can be seen in FIG. 3.

The feed conveyor 20 is equipped, above the packs 10, with an upper wall 52 exerting a restraining force on the packs 10. In the present case, this upper wall 52 is designed as a brush strip with a downward-pointing brush 53 which rests against the packs 10. The drying turret 13 is equipped all round with drying pockets 25 and 26. Each serves for receiving a pack 10. As can be seen, two drying pockets 25, 26 are respectively arranged immediately next to one another in a common plane of the drying turret 13. The two drying pockets 25, 26 are divided off from one another merely by means of a thin partition wall 27.

Figure 3:
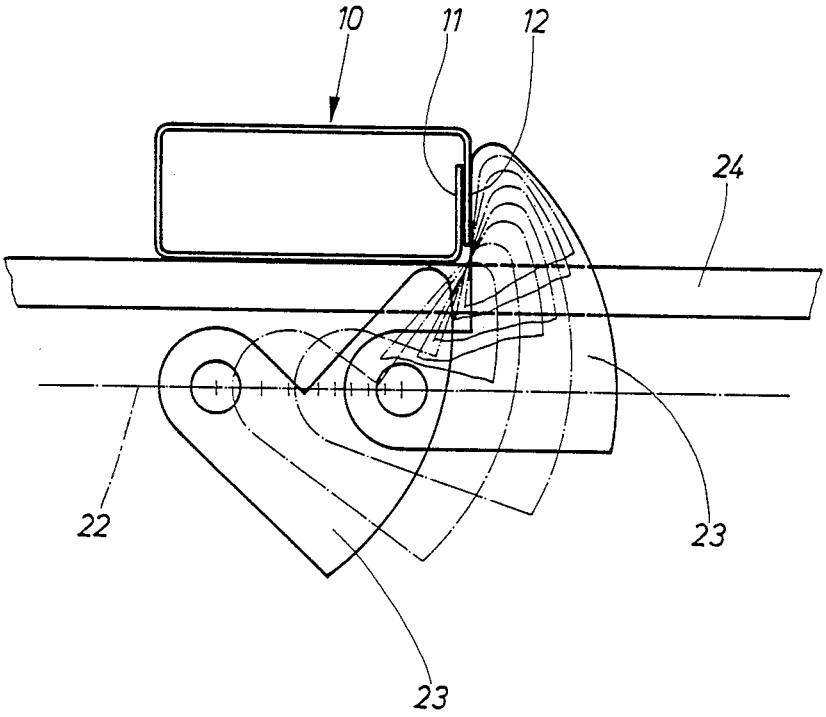
FIG. 3 shows a side view of a detail of a feed conveyor for the packs on a further-enlarged scale.

The drying pockets 25, 26 are arranged in the drying turret 13 in such a way that the cuboid packs 10 point forwards in the pushing-in direction with an upper end wall 28. At the same time, a large-surface front face 29 is directed upwards or downwards. The narrow side walls 18, in the region of which glue is applied according to the exemplary embodiment of FIG. 3, are directed laterally and therefore determine the width or height of the drying pockets 25, 26. The relative position of the packs 10 which is described here corresponds to that on the feed conveyor 20 and in the region of the supply station 21.

The two drying pockets 25, 26 of a pocket group which are located next to one another extend in a plane which is directed at a very small angle relative to the radial plane of the drying turret 13. This imbricated relative positioning of the pairs of drying pockets 25, 26 allows an optimum utilization of space of the drying turret 13 for a predetermined diameter. The drying pockets 25, 26 are adjacent to the outer edge.

Because of the above-described relative arrangement of the two drying pockets 25, 26, the supply station 21 is located at a distance below the horizontal main plane 16, in particular where two respective drying pockets 25, 26 lying next to one another are aligned in a horizontal plane. Here, two packs 10 located next to one another are pushed simultaneously into the two associated drying pockets 25, 26 by means of a common double slide 30. The depth of the drying pockets 25, 26 in the axial direction is such that the packs 10 project slightly from the drying pockets 25, 26, that is to say beyond the structure of the drying turret 13, on both sides, in particular in the region of the end wall 28 and in the region of an opposite bottom 31.

After two packs 10 have been pushed in, the drying turret is transported further one stroke, specifically in the anti-clockwise direction in the exemplary embodiment of FIG. 1. The packs 10 accordingly remain in the drying pockets 25, 26 within a range of (intermittent) rotation of approximately 270° . The drying pockets 25, 26 are heated in order to accelerate the setting or hardening of the glue spots.

After the abovementioned rotary travel, the packs 10 enter the region of a pushing-out station 32. This is determined by the fact that the drying pockets 25, 26 are aligned in a vertical plane here. On their way from the supply station 21 to the pushing-out station 32, the packs 10 are kept in shape in the drying pockets 25, 26 of exact size. For this purpose, a guide wall 33, 34 in the form of a part circle is arranged outside the supply station 21 and the pushing-out station 32 on both sides of the drying turret 13. These guide walls 33, 34 are attached fixedly, specifically at such a distance from the side faces of the drying turret 13 which face them that the packs 10 are moved along the guide walls 33, 34 at only a very slight distance from the end wall 28 and bottom 31. Any dimensional inaccuracies are thereby compensated by means of the guide walls 33, 34.

In the region of the pushing-out station 32, the two packs 10 are simultaneously conveyed by an ejector 35 out of the drying pockets 25, 26 located above one another in a vertical plane and onto an intermediate platform (not shown) and are delivered from the latter to a discharge conveyor 36 as a result of a transverse shift. In the present case, the latter consists of two conveyor belts 37, 38 which run on both sides of the path of movement of the packs 10 and the conveying strands of which receive the row of packs 10 between them with a clamping effect and convey them away. The packs 10 are pushed into the region between the conveying strands of the conveyor belts 37, 38 by a slide 39 moved to and fro in the horizontal direction.

The pushing of the packs 10 into the drying pockets 25, 26 and the pushing out from the latter can be associated with the attachment of a closing stamp 40 or a revenue stamp 41 in the region of the end wall 28. This is possible because the packs 10 are pushed into the drying pockets 25, 26 and out of them in one and the same direction with the end wall 28 directed forwards. The closing stamp 40 or revenue stamp 41 extending transversely over the end wall 28 is attached during the pushing-in phase or during the pushing-out phase.

The closing stamp 40 can be attached as early as when the packs 10 are conveyed into the drying turret 13. For this purpose, a supply device for two closing stamps 40 is arranged in the gap-shaped interspace between the feed conveyor 20 and the drying turret 13. This supply device consists of a mouthpiece disc 42 with two rectangular mouthpiece orifices 43, 44. These are made rectangular, of a size corresponding approximately to the cross-section of the pack 10. The respective closing stamp 40 is arranged centrally in a vertical position transversely in front of the mouthpiece orifices 43, 44. When the packs 10 are pushed into the drying pockets 25, 26, the packs 10 are pushed through the mouthpiece orifices 43, 44. At the same time, the closing stamps 40 lying in front of the mouthpiece orifices are taken up and are laid in a U-shaped manner around the end wall 28 and the adjacent front or rear wall. The packs 10 accordingly enter the drying pockets 25, 26 together with the correctly attached closing stamp 40.

The closing stamps 40 are extracted from a magazine 54 designed in a suitable way and having a plurality of reels 55 brought successively into position. The closing stamps in the form of strips provided with an adhesive on one side are severed in succession from continuous web material.

In the region of the rotary path of the drying turret 13 is formed a defective-product pushing-out station 45. This is in a position above the main plane 16 in which the drying pockets 25, 26 located next to one another are likewise in horizontal alignment. Separate pushing-out rams 46, 47 are assigned to the two drying pockets 25, 26 in this region. These are controlled by a cigarette-testing device (not shown) which checks the packs 10 or cigarette groups for defective cigarettes at a suitable location, especially in the region of the folding turret 14. The particular pack is then ejected in the region of the defective-product pushing-out station 45, specifically individually for one drying pocket 25, 26 or the other.

Since separating out defective packs with a revenue stamp 41 would involve a high outlay in terms of cost, a device for attaching revenue stamps 41 is arranged after the defective-product pushing-out station 45 in the conveying travel of the packs 10, so that only correct packs 10 are provided with a revenue stamp 41. Arranged in the region of the pushing-out station 32, in a vertical plane, between the drying turret 13 and the discharge conveyor 36 or a platform assigned to the latter is a mouthpiece disc 48 driven to rotate. The latter has four pairs of mouthpiece orifices 49, 50 located next to one another and arranged distributed along the periphery, specifically in such a way that, after a quarter rotation, two of the mouthpiece orifices 49, 50 are arranged above one another in a vertical plane and are aligned with the path of movement of the packs 10 when these are pushed out of the drying pockets 25, 26. The two packs 10 are accordingly moved through the mouthpiece orifices 49, 50.

Revenue stamps 41 directed transversely relative to the mouthpiece orifices 49, 50 and covering the latter centrally are arranged on the mouthpiece disc 48 on the side facing the drying turret 13. During the pushing-through movement of the packs 10, the revenue stamps, with the free side having an adhesive, come up against the end wall 28 and the adjacent regions of the front sides of the pack. The revenue stamps 41 are accordingly attached in the correct position before the packs 10 pass into the discharge conveyor 36.

After each work cycle, the mouthpiece disc 48 is moved further one quarter circle. The particular mouthpiece orifices 49, 50 located at the top and directed horizontally are provided with revenue stamps 41 in the relative position described. The revenue stamps are extracted from a vertical stamp magazine 51.

We claim:

1. Packaging machine for cuboid packs having glue bonds, comprising:

a folding turret (14) and a following drying turret (13) for temporarily receiving the ready-folded packs (10) into drying pockets (25, 26);

a feed conveyor (20) for the drying turret (13);

arranged between said feed conveyor (20) and said drying turret (13), a first mouthpiece disk (42) with first mouthpiece orifices (43, 44) through which the packs (10) are moved when pushed into the drying pockets (25, 26);

means for feeding a transversely directed closing stamp (40) across an end wall (28) of the pack (10) on the entry side of each of the first mouthpiece orifices (43, 44);

arranged between the drying turret (13) and a discharge conveyor (36), a rotatable second mouthpiece disk (48) with several second mouthpiece orifices (49, 50) through which the packs (10) are moved when they are pushed out of the drying pockets (25, 26); and means for feeding revenue stamps (41) in front of each of the second mouthpiece orifices (49, 50) and bondable to the packs (10) when laid against the end wall (28) in a U-shaped manner.

2. Packaging machine according to claim 10, wherein said drying turret (13) is rotatable about a horizontal axis, wherein said drying pockets (25, 26) are open at both ends in the axial direction, each for receiving a pack (10), and wherein two of said drying pockets are arranged next to one another in a radial plane or in a plane directed at a small angle relative to the radial plane.

3. Packaging machine according to claim 1, wherein the drying pockets (25, 26) point with the larger dimension in the axial direction and with the medium dimension approximately in the radial direction.

4. Packaging machine according to claim 1 wherein the packs (10) project slightly at both ends from the drying turret (13).

5. Packaging machine according to claim 1, wherein the packs (10) are pushed off in the axial direction in pairs, when there are two drying pockets (25, 26) located next to one another, from said horizontal feed conveyor (20) running next to the drying turret (13), and into drying pockets (25, 26) which are in a horizontal position.

6. Packaging machine according to claim 2, wherein the packs (10) are conveyed by the drying turret (13) along a path of movement of approximately 270° and are pushed out in a pushing-out station (32), the drying pockets (25, 26) to be emptied being aligned vertically.

7. Packaging machine according to claim 2, wherein the packs (10) are pushed into the drying pockets (25, 26) and out again in one and the same direction.

8. Packaging machine according to claim 1, wherein the second mouthpiece disc (48) has four said second mouthpiece orifices (49, 50) which are arranged distributed in pairs and which, as a result of rotations of the second mouthpiece disc (48) through a quarter circle, are moved successively into a position corresponding to the drying pockets (25, 26).

* * * * *